US007924237B2

(12) United States Patent
Lai et al.

(10) Patent No.: US 7,924,237 B2
(45) Date of Patent: Apr. 12, 2011

(54) ANTENNA DEVICE

(75) Inventors: Ming-lu Lai, Taipei (TW); Tzung-Yu Wu, Taipei (TW); Yung-Chi Fan, Taipei (TW); Chun-Hsiung Wang, Taipei (TW)

(73) Assignee: Asustek Computer Inc., Taipei (TW)

( * ) Notice: Subject to any disclaimer, the term of this patent is extended or adjusted under 35 U.S.C. 154(b) by 354 days.

(21) Appl. No.: 12/289,114

(22) Filed: Oct. 21, 2008

(65) Prior Publication Data

US 2009/0115681 A1 May 7, 2009

(30) Foreign Application Priority Data

Nov. 1, 2007 (TW) ..... 96141205 A

(51) Int. Cl.
*H01Q 1/50* (2006.01)

(52) U.S. Cl. ..... 343/850

(58) Field of Classification Search ..... 343/850, 343/846, 700 MS, 702, 897, 848, 767
See application file for complete search history.

(56) References Cited

U.S. PATENT DOCUMENTS 4,364,050 A * 12/1982 Lopez ..... 343/700 MS
5,872,542 A * 2/1999 Simons et al. ..... 343/700 MS
6,008,763 A * 12/1999 Nystrom et al. ..... 343/700 MS
6,937,193 B2 8/2005 Hendler et al.
7,271,777 B2 9/2007 Yuanzhu
7,463,198 B2 * 12/2008 Deaett et al. ..... 343/700 MS
2004/0239567 A1 * 12/2004 Van Der Poel ..... 343/700 MS
2007/0139275 A1 * 6/2007 Deaett et al. ..... 343/700 MS

FOREIGN PATENT DOCUMENTS

CN 1525596 A 1/2006
JP 2003234615 A 8/2003
TW M243799 9/2004

* cited by examiner

*Primary Examiner* — Huedung Mancuso
(74) *Attorney, Agent, or Firm* — Bacon & Thomas, PLLC

(57) ABSTRACT

An antenna device including a substrate, a ground layer, a first feeding element, a second feeding element, a first control circuit and a second control circuit is provided. The substrate has a top surface and a lower surface. The ground layer disposed on the lower surface includes a first, a second and a third ground portions. The third ground portion is separated from the first and the second ground portions by a first and a second slots, respectively. The first and the second feeding elements include a first and a second conductive feeding lines, respectively. The first and the second conductive feeding lines cross over the first and the second slots and are electrically connected to the first and the second ground portions, respectively. The radiation pattern of the antenna device is variable by selectively operating the first, the second, the third and the fourth control circuits.

11 Claims, 15 Drawing Sheets

10

S11

ANTENNA DEVICE

This application claims the benefit of Taiwan application Serial No. 96141205, filed Nov. 1, 2007, the subject matter of which is incorporated herein by reference.

BACKGROUND OF THE INVENTION

1. Field of the Invention

The invention relates in general to an antenna device, and more particularly to a multiple-input multiple-output (MIMO) antenna device capable of adjusting the radiation pattern.

2. Description of the Related Art

Multiple-input multiple-output (MIMO) technology will become a mainstream technology in wireless communication in the future. Unlike conventional single antenna systems, many antennas are operated concurrently in MIMO systems, so that the data transmission in the wireless network is more stable and the data transmission rate is increased. At present, the MIMO technology has become standardized specification in communication protocols such as IEEE 802.11n (WiFi) and 802.16d/e (WiMAX). Recently, adaptive MIMO systems have been provided. The adaptive MIMO systems refer to systems that the coding method and the antenna characteristics are adjustable, so that the adaptive MIMO system is capable of achieving an optimum working mode according to the real-time state of wireless channels. Therefore, the design of antennas with adjustable radiation characteristics is essential in adaptive MIMO systems.

As too much space of a wireless communication product is occupied by one conventional antenna, it is very difficult to install many antennas whose radiation characteristics are adjustable. Thus, the antenna design is a bottleneck to break through for an electronic product to in-build many communication systems operated in different frequency bands and adopting the MIMO technology.

Accordingly, the MIMO antenna system whose size is small and the radiation characteristics are adjustable heralds whether future small-sized electronic devices can fully utilize the resources of the wireless network.

SUMMARY OF THE INVENTION

The invention is directed to an antenna device which achieves a small-sized MIMO antenna device by at least two sets of independent slot antennas incorporating with independent control circuits, respectively.

According to the present invention, an antenna device including a substrate, a ground layer, a first feeding element, a second feeding element, a first control circuit, a second control circuit, a third control circuit and a fourth control circuit is provided. The substrate has a top surface and a lower surface. The ground layer disposed on the lower surface includes a first ground portion, a second ground portion and a third ground portion. The third ground portion is separated from the first ground portion and the second ground portion by a first slot and a second slot, respectively. The first slot has a first segment and a second segment. The first segment and the second segment form a first angle. The second slot has a third segment and a fourth segment. The third segment and the fourth segment form a second angle. The first feeding element and the second feeding element are disposed on the top surface and respectively include a first conductive feeding line and a second conductive feeding line. The first conductive feeding line crosses over the first slot and passes through the substrate to be electrically connected to the first ground portion. The second conductive feeding line crosses over the second slot and passes through the substrate to be electrically connected to the second ground portion. The first control circuit and the second control circuit are disposed on the top surface and respectively include a first wire and a second wire. The first wire crosses over the corresponding position of the first segment of the first slot on the top surface and passes through the substrate to be electrically connected to the first ground portion. The second wire crosses over the corresponding position of the second segment of the first slot on the top surface and passes through the substrate to be electrically connected to the first ground portion. The third control circuit and the fourth control circuit are disposed on the top surface and respectively include a third wire and a fourth wire. The third wire crosses over the corresponding position of the third segment of the second slot on the top surface and passes through the substrate to be electrically connected to the second ground portion. The fourth wire crosses over the corresponding position of the fourth segment of the second slot on the top surface and passes through the substrate to be electrically connected to the second ground portion.

The invention will become apparent from the following detailed description of the preferred but non-limiting embodiments. The following description is made with reference to the accompanying drawings.

DETAILED DESCRIPTION OF THE INVENTION

First Embodiment

Figure 1A:
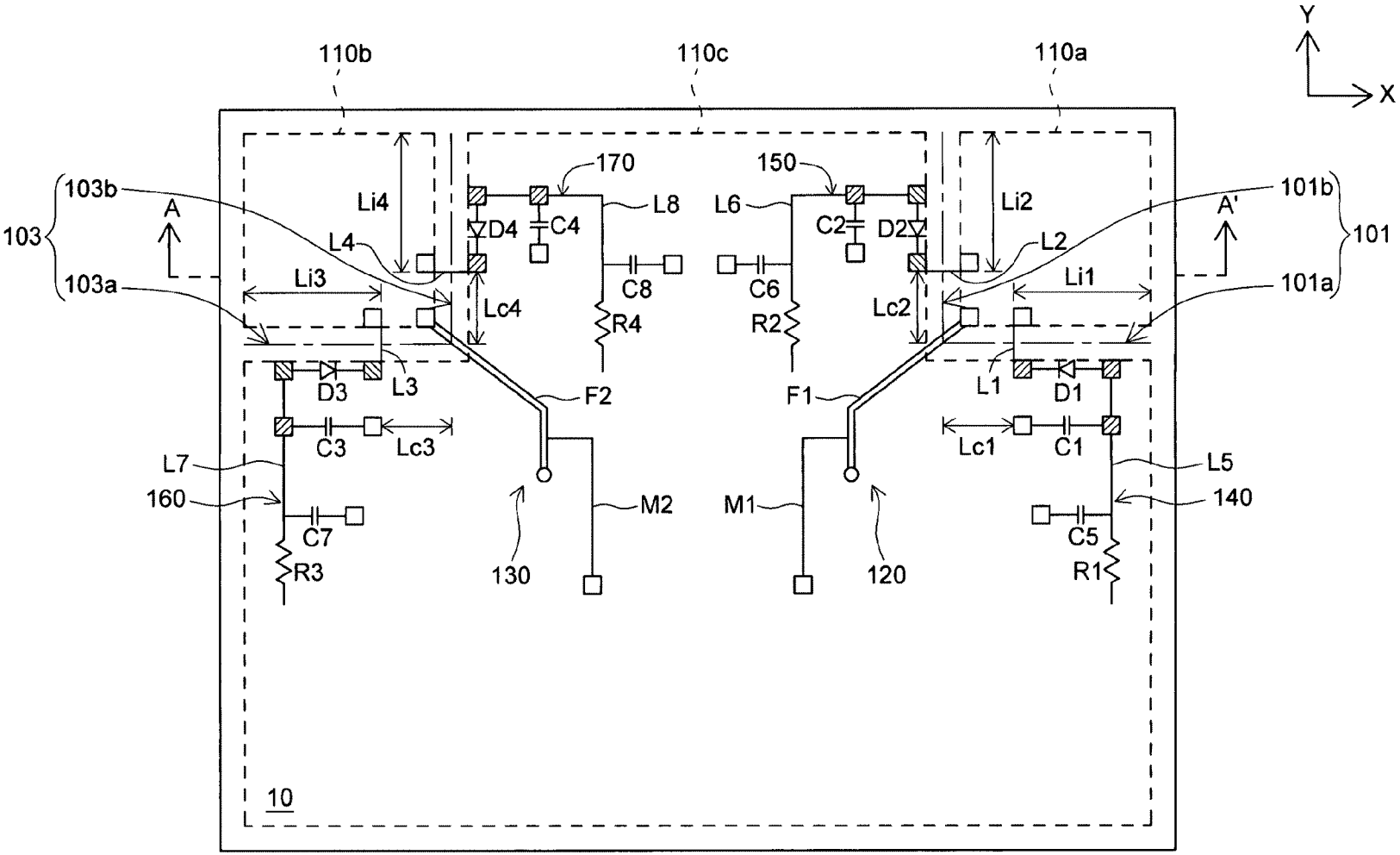
FIG. 1A shows a plane view of an antenna device according to a first embodiment of the invention.
Figure 2:
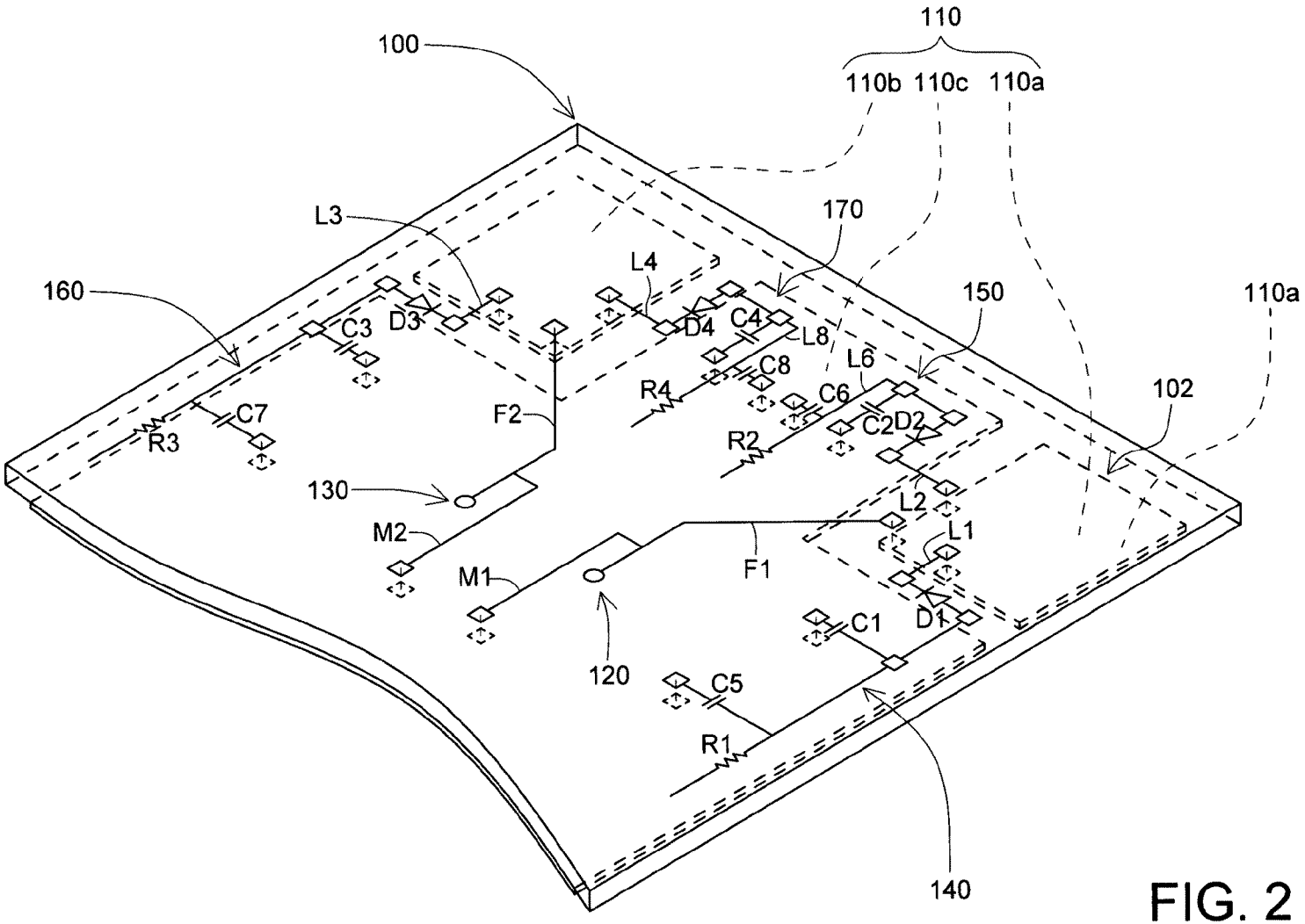
FIG. 2 shows a perspective view of the antenna device in FIG. 1A.

Referring to FIG. 1A and FIG. 2 at the same time, a plane view of an antenna device according to a first embodiment of the invention is shown in FIG. 1A, and a perspective view of the antenna device in FIG. 1A is shown in FIG. 2. The antenna device 10 includes a substrate 100, a ground layer 110, a first feeding element 120, a second feeding element 130, a first control circuit 140, a second control circuit 150, a third control circuit 160 and a fourth control circuit 170. The substrate 100 has a top surface 102 and a lower surface 104.

Figure 1B:
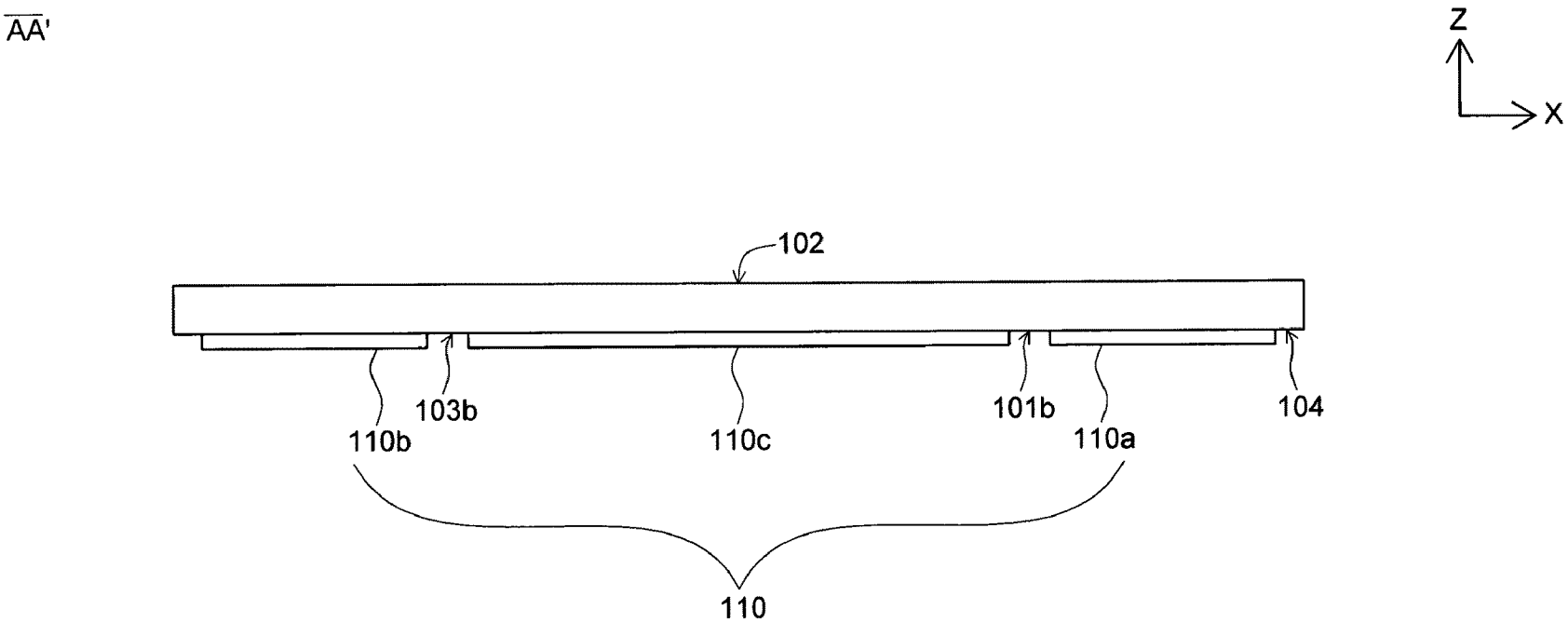
FIG. 1B shows a cross-sectional view along a cross-sectional line AA' in FIG. 1A.

Referring to FIG. 1B, a cross-sectional view along a cross-sectional line AA' in FIG. 1A is shown. As indicated in FIG. 1B, the ground layer 110 disposed on the lower surface 104 includes a first ground portion 110*a*, a second ground portion 110*b* and a third ground portion 110*c*. The third ground portion 110*c* is separated from the first ground portion 110*a* and the second ground portion 110*b* by a first slot 101 and a second slot 103, respectively.

Referring to FIG. 1A, the first slot 101 has a first segment 101*a* and a second segment 101*b*. The first segment 101*a* and the second segment 101*b* extend in different directions. The second slot 103 has a third segment 103*a* and a fourth segment 103*b*. The third segment 103*a* and the fourth segment 103*b* extend in different directions. Preferably, the first segment 101*a* and the second segment 101*b* extend towards the positive direction of the X-axis and the positive direction of the Y-axis, respectively. The angle between the first segment 101*a* and the second segment 101*b* is substantially 90 degrees. Preferably, in the present embodiment of the invention, the first slot 101 and the second slot 103 form a mirror-image symmetric structure with respect to the central line of the substrate 100 along the Y-axis direction, so that the third segment 103*a* and the fourth segment 103*b* extend towards the negative direction of the X-axis and the positive direction of the Y-axis, respectively. Therefore, the angle between the third segment 103*a* and the fourth segment 103*b* is substantially 90 degrees as well. In addition, in the present embodiment of the invention, the length of the first segment 101*a* is preferably equal to that of the second segment 101*b*, and the length of the third segment 103*a* is preferably equal to that of the fourth segment 103*b*.

As indicated in FIG. 1A, the first feeding element 120 and the second feeding element 130 are disposed on the top surface 102 and respectively include a first conductive feeding line F1 and a second conductive feeding line F2. The first conductive feeding line F1 and the second conductive feeding line F2 cross over the first slot 101 and the second slot 103 and pass through the substrate 100 through vias to be electrically connected to the first ground portion 110*a* and the second ground portion 110*b*, respectively. In the present embodiment of the invention, the first slot 101 and the second slot 103 are used for forming slot antennas. After signals are fed into the first feeding element 120 and the second feeding element 130, the current will flow on the grounding surface at the sides of the first slot 101 and the second slot 103 for radiating electromagnetic signals. Besides, the first slot 101 and the second slot 103 can also be used as received antennas for receiving wireless signals.

As indicated in FIG. 1A, the first feeding element 120 further includes a first microstrip line M1. The length of the first microstrip line M1 is approximately ¼ wavelength of a guided wave. One terminal of the first microstrip line M1 is electrically connected to the first conductive feeding line F1. The other terminal of the first microstrip line M1 is electrically connected to the third ground portion 110*c*. Likewise, the second feeding element 130 further includes a second microstrip line M2. The length of the second microstrip line M2 is approximately ¼ wavelength of the guided wave. One terminal of the second microstrip line M2 is electrically connected to the second conductive feeding line F2, and the other terminal of the second microstrip line M2 is electrically connected to the third ground portion 110*c*.

As indicated in FIG. 1A and FIG. 2, the first control circuit 140 and the second control circuit 150 are disposed on the top surface 102 and respectively include a first wire L1 and a second wire L2. The first wire L1 crosses over the corresponding position of the first segment 101*a* of the first slot 101 on the top surface 102 and passes through the substrate 100 through the via to be electrically connected to the first ground portion 110*a*. The second wire L2 crosses over the corresponding position of the second segment 101*b* of the first slot 101 on the top surface 102 and passes through the substrate 100 thought the via to be electrically connected to the first ground portion 110*a*. The third control circuit 160 and the fourth control circuit 170 are disposed on the top surface 102 and respectively include a third wire L3 and a fourth wire L4. The third wire L3 crosses over the corresponding position of the third segment 103*a* of the second slot 103 on the top surface 102 and passes through the substrate 100 through the via to be electrically connected to the second ground portion 110*b*. The fourth wire L4 crosses over the corresponding position of the fourth segment 103*b* of the second slot 103 on the top surface 102 and passes through the substrate 100 through the via to be electrically connected to the second ground portion 110*b*.

Furthermore, the first control circuit 140 further includes a first diode D1, and the first wire L1 is electrically connected to the cathode of the first diode D1. The second control circuit 150 further includes a second diode D2, and the second wire L2 is electrically connected to the cathode of the second diode D2. By respectively controlling the voltage applied to the anodes of the first diode D1 and the second diode D1, the first diode D1 and the second diode D2 can be selectively conducted. Thus, the current distribution near the first slot 101 can be changed by respectively controlling the current passing through the first wire L1 and the second wire L2, so that the radiation pattern of the antenna formed by the first slot 101 is changed. That is, the radiation pattern of the antenna formed by the first slot 101 is controlled via the first control circuit 140 and the second control circuit 150 in the present embodiment of the invention.

Likewise, the third control circuit 160 further includes a third diode D3, and the third wire L3 is electrically connected to the cathode of the third diode D3. The fourth control circuit 170 further includes a fourth diode D4, and the fourth wire L4 is electrically connected to the cathode of the fourth diode D4. The third control circuit 160 and the fourth control circuit 170 can be used to change the radiation pattern of the antenna formed by the second slot 103 by respectively controlling the third diode D3 and the fourth diode D4 to be conducted or not. Besides, the antennas formed by the first slot 101 and the second slot 103 are independent antennas having independent feeding elements and control circuits, respectively. Thus, the antenna device 10 having a multiple-input multiple-output (MIMO) structure is capable of changing the radiation pattern. The antenna device 10 of the present embodiment is not only capable of increasing the data transmission rate and enhancing the capability and the stability of the signal transmission, but it is also capable of achieving an optimum mode to receive/transmit signals by changing the radiation pattern.

Figure 8A:
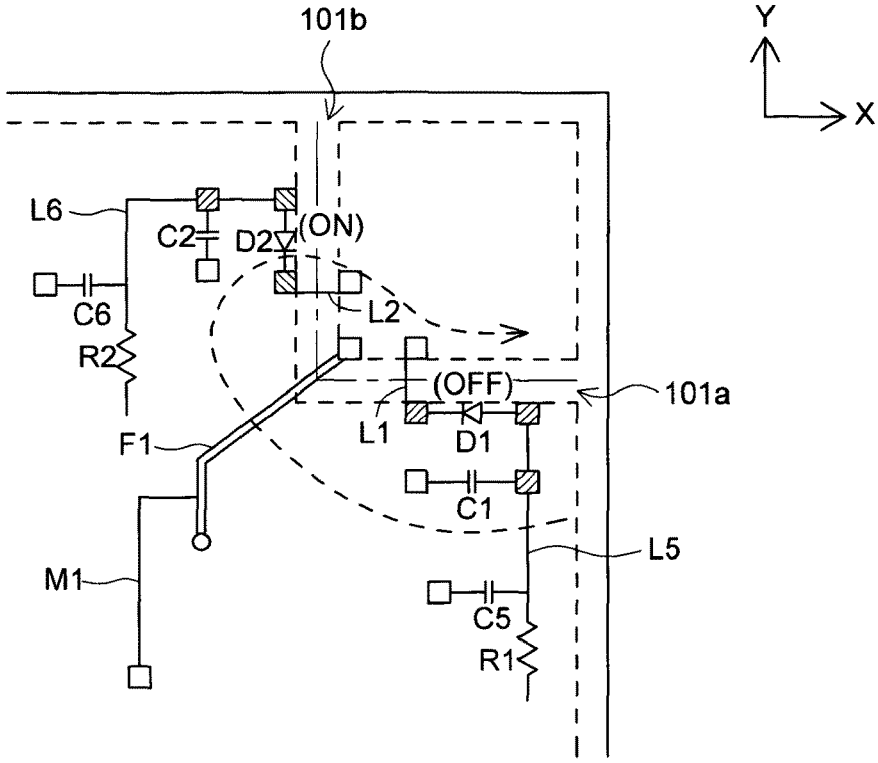
FIG. 8A shows a current path diagram near the first slot operated in the working mode X.
Figure 8B:
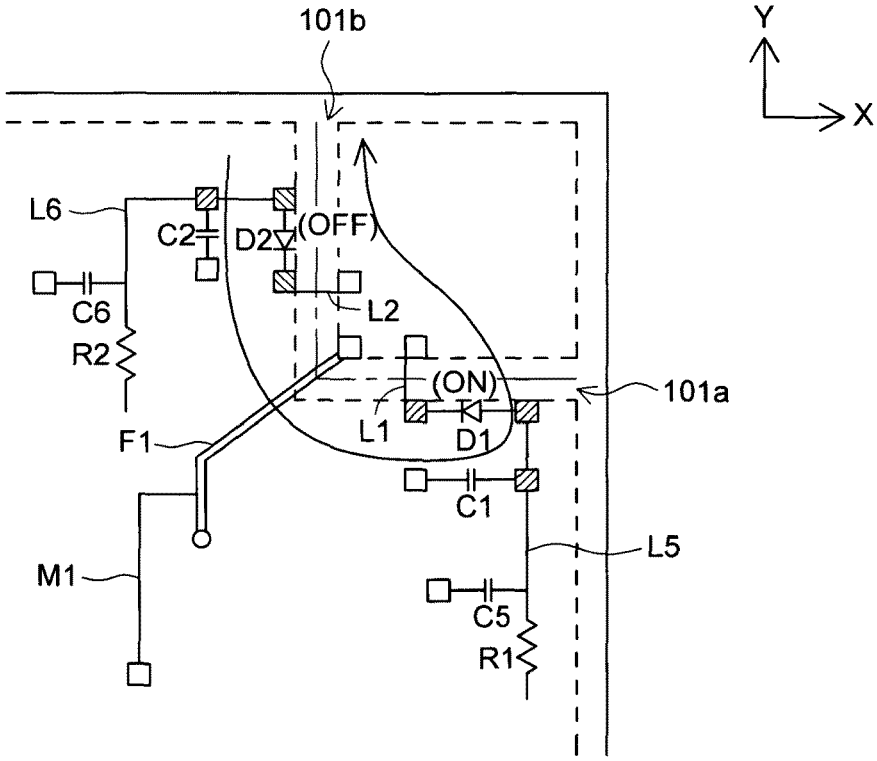
FIG. 8B shows a current path diagram near the first slot operated in the working mode Y.

The operation ways of the present embodiment in different working modes are illustrated below. Two independent antennas of the present embodiment of the invention respectively controlled by two independent control circuits have four working modes. For example, when the second diode D2 is conducted, the first slot 101 uses the first segment 101*a* extending along the X-axis direction as the main radiator to be operated in the working mode X. Meanwhile, the current path near the first slot 101 is illustrated in FIG. 8A, for example. When the first diode D1 is conducted, the first slot 101 uses the second segment 101*b* extending along the Y-axis direction as the main radiator to be operated in the working mode Y. Meanwhile, the current path near the first slot 101 is illustrated in FIG. 8B, for example. Likewise, when the fourth diode D4 is conducted, the second slot 103 uses the third segment 103*a* extending along the X-axis direction as the main radiator to be operated in the working mode X. When the third diode D3 is conducted, the third slot 103 uses the fourth segment 103*b* extending along the Y-axis direction as the main radiator to be operated in the working mode Y.

The first slot 101 and the second slot 103 are defined as being operated in the working mode X when using the portion extending along the X-axis direction as the main radiator. The first slot 101 and the second slot 103 are defined as being operated in the working mode Y when using the portion extending along the Y-axis direction as the main radiator. The first slot 101 and the second slot 103 are defined as being operated in the working mode XX when the antenna formed by the first slot 101 is operated in the working mode X and the antenna formed by the second slot 103 is operated in the working mode X. The antenna device 10 can also be defined as being operated in the working mode XY, the working mode YX and the working mode YY. The first slot 101 and the second slot 103 are defined as being operated in the working mode XY when the antennas formed by the first slot 101 and the second slot 103 are operated in the working mode X and the working mode Y, respectively. The first slot 101 and the second slot 103 are defined as being operated in the working mode YX when the antennas formed by the first slot 101 and the second slot 103 are operated in the working mode Y and the working mode X, respectively. The first slot 101 and the second slot 103 are defined as being operated in the working mode YY when the antennas formed by the first slot 101 and the second slot 103 are both operated in the working mode Y.

Referring to FIG. 1A again, let the lengths of the first segment at the two sides of the first wire L1 respectively be Li1 and Lc1, and the lengths of the second segment at the two sides of the second wire L2 respectively be Li2 and Lc2. Preferably, the following conditions are satisfied:

$$Li1+Lc1+Lc2\approx 0.25\lambda_g$$

$$Li2+Lc1+Lc2\approx 0.25\lambda_g$$

wherein $\lambda_g$ is the wavelength of the guided wave.

According to the above-described design, no matter what the working mode that the antenna is operated in, the guided wave can resonate with the first slot 101 to generate an electromagnetic signal with a desired frequency. Also, the frequencies of the electromagnetic wave respectively generated when the antenna is operated in the working mode X and working mode Y can be designed to be different as long as the sum of (Li1+Lc1+Lc2) differs from the sum of (Li2+Lc1+Lc2).

Likewise, let the lengths of the third segment at the two sides of the third wire L3 respectively be Li3 and Lc3, and the lengths of the fourth segment at the two sides of the fourth wire L4 respectively be Li4 and Lc4. Preferably, the following conditions are satisfied:

$$Li3+Lc3+Lc4\approx 0.25\lambda_g$$

$$Li4+Lc1+Lc2\approx 0.25\lambda_g$$

Besides, the first control circuit 140 and the second control circuit 150 respectively include a first capacitor C1 and a second capacitor C2. One terminal of the first capacitor C1 and one terminal of the second capacitor C2 are coupled to the anode of the first diode D1 and the anode of the second diode D2, respectively. The other terminals of the first capacitor C1 and the second capacitor C2 are electrically coupled to the third ground portion 110*c*, as indicated in FIG. 2.

Likewise, the third control circuit 160 and the fourth control circuit 170 respectively include a third capacitor C3 and a fourth capacitor C4. One terminal of the third capacitor C3 and one terminal of the fourth capacitor C4 are coupled to the anode of the third diode D3 and the anode of the fourth diode D4, respectively. The other terminals of the third capacitor C3 and the fourth capacitor C4 are electrically connected to the third ground portion 110*c*.

The first control circuit 140 further includes a fifth capacitor C5 and a fifth wire L5. The second control circuit 150 further includes a sixth capacitor C6 and a sixth wire L6. One terminal of the fifth capacitor C5 and one terminal of the sixth capacitor C6 are electrically connected to the third ground portion 110*c*. The fifth wire L5 is connected to the first capacitor C1 and the fifth capacitor C5, and the sixth wire L6 is connected to the second capacitor C2 and the sixth capacitor C6. The length of the fifth wire L5 is approximately ¼ wavelength of the guided wave, and the length of the sixth wire L6 is approximately ¼ wavelength of the guided wave.

Likewise, the third control circuit 160 further includes a seventh capacitor C7 and a seventh wire L7, and the fourth control circuit 170 further includes an eighth capacitor C8 and an eighth wire L8. One terminal of the seventh capacitor C7 and one terminal of the eighth capacitor C8 are electrically connected to the third ground portion 110*c*. The seventh wire L7 is connected to the third capacitor C3 and the seventh capacitor C7. The eighth wire L8 is connected to the fourth capacitor C4 and the eighth capacitor C8. The length of the seventh wire L7 is approximately ¼ wavelength of the guided wave, and the length of the eighth wire L8 is approximately ¼ wavelength of the guided wave.

The first control circuit 140 further includes a first resistor R1 coupled between a signal input terminal of the first control circuit 140 and one terminal of the fifth capacitor C5. The second control circuit 150 further includes a second resistor R2 coupled between a signal input terminal of the second control circuit 150 and one terminal of the sixth capacitor C6. The third control circuit 160 further includes a third resistor R3 coupled between a signal input terminal of the third control circuit 160 and one terminal of the seventh capacitor C7. The fourth control circuit 170 further includes a fourth resistor R4 coupled between a signal input terminal of the fourth control circuit 170 and one terminal of the eighth capacitor C8. The high current generated to pass through the control circuits can be avoided by the disposition of the resistors.

Figure 9:
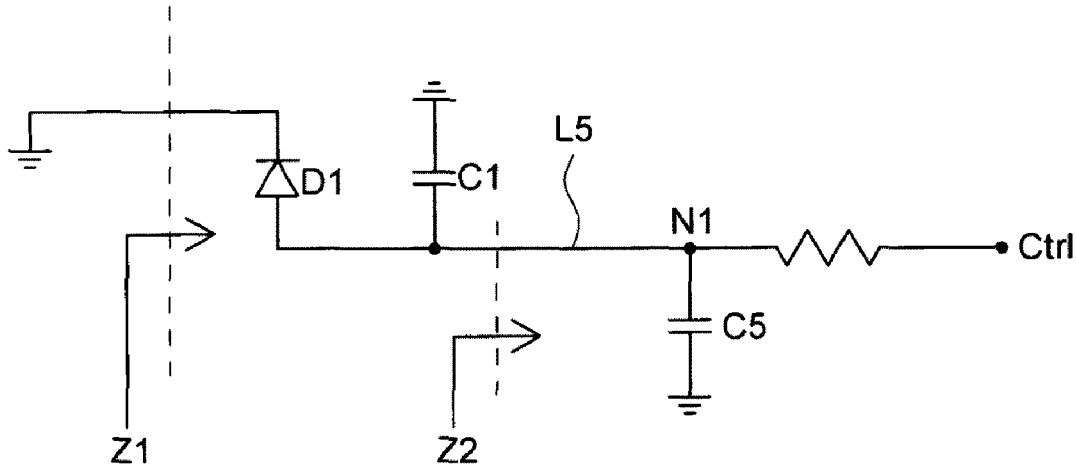
FIG. 9 shows an equivalent circuit diagram of the first control circuit of the first embodiment.

Referring to FIG. 9, an equivalent circuit diagram of the first control circuit 140 of the first embodiment is shown. The fifth capacitor C5 enables the node N1 to be grounded in high frequency without affecting the direct current voltage at the node N1. Thus, one terminal of the fifth wire L5 can be treated as being grounded when in high frequency, and the direct current voltage of the control signal Ctrl inputted to the first control circuit 140 controls the first diode D1 via the node N1.

In order to achieve the resonance, the imaginary part of the equivalent impedance Z1 with respect to the anode of the first diode D1 is treated as zero. As the first diode D1 is forward conducted, the first diode D1 has the inductance effect. As the length of the fifth wire L5 is approximately ¼ wavelength of the guided wave. One terminal of the fifth wire L5 is equivalently grounded when in high frequency, the equivalent impedance Z2 with respect to the other side of the fifth wire L5 is infinite. Thus, with the disposition of the first capacitor C1 and the appropriate selection of the capacitant value of the first capacitor C1, the imaginary part of the sum of the impedance of the first capacitor C1 and the impedance of the equivalent inductance of the first diode D1 when being forward conducted can be zero to meet the requirements of the resonance. The operation of the other control circuits are similar to the above disclosure and is not repeated here.

Figure 3B:
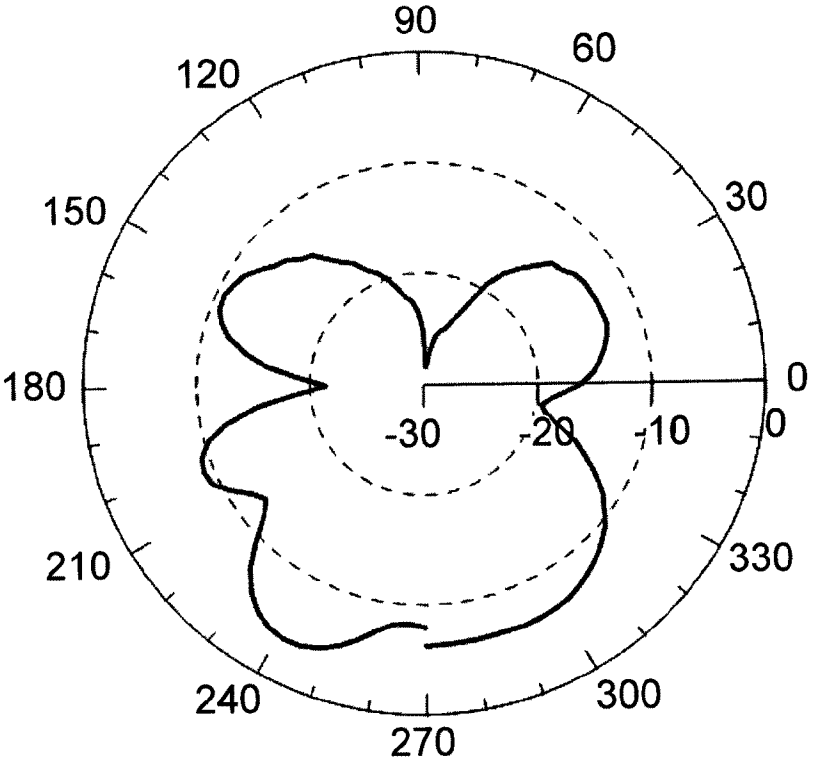
FIGS. 3A-3F show the measured and the simulated field patterns of the antenna device of the first embodiment of the invention in the working mode XY.
Figure 3A:
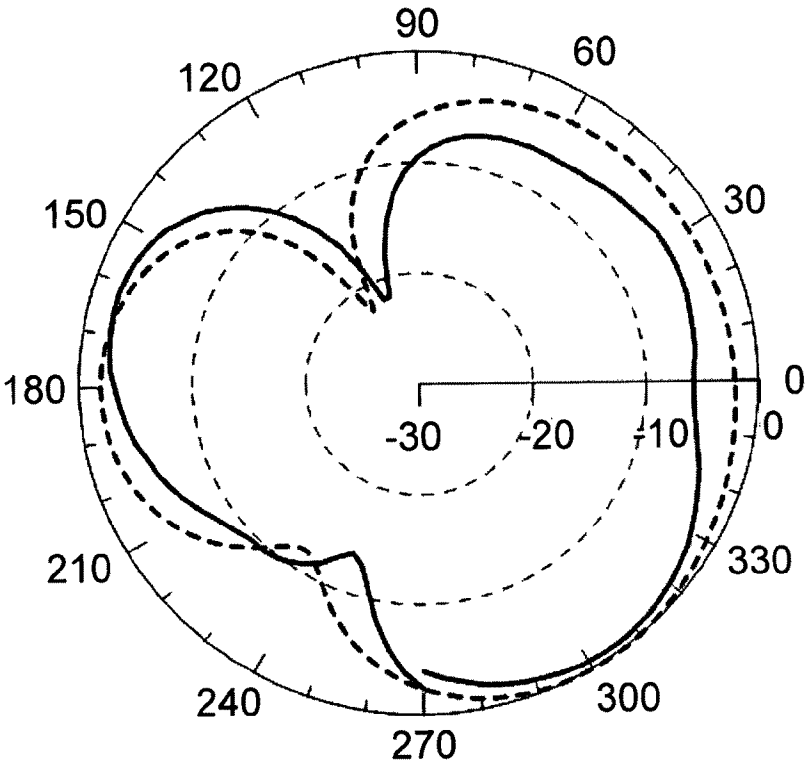
Figure 3D:
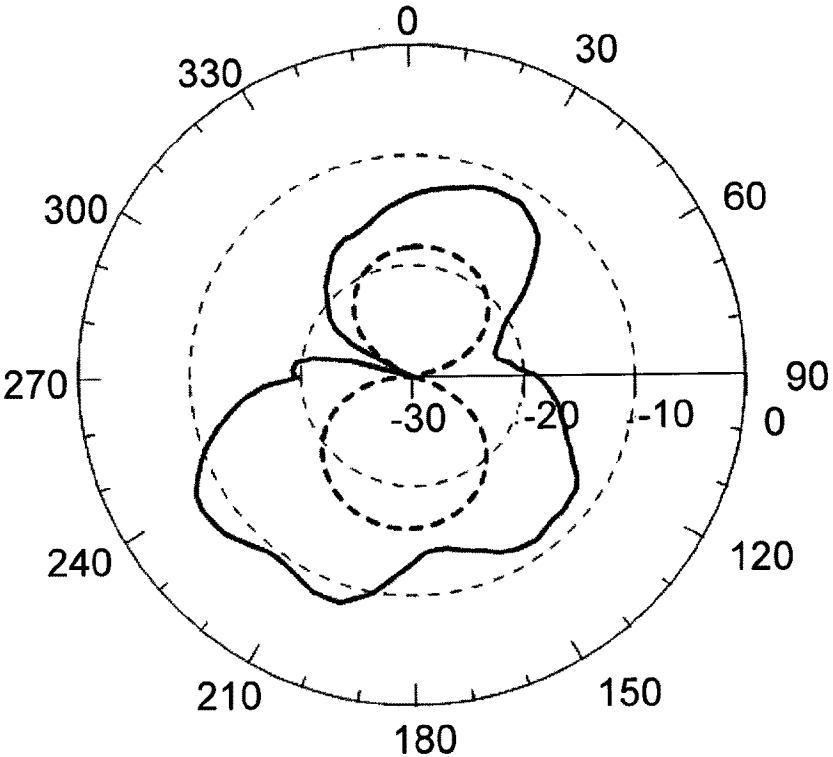
Figure 3C:
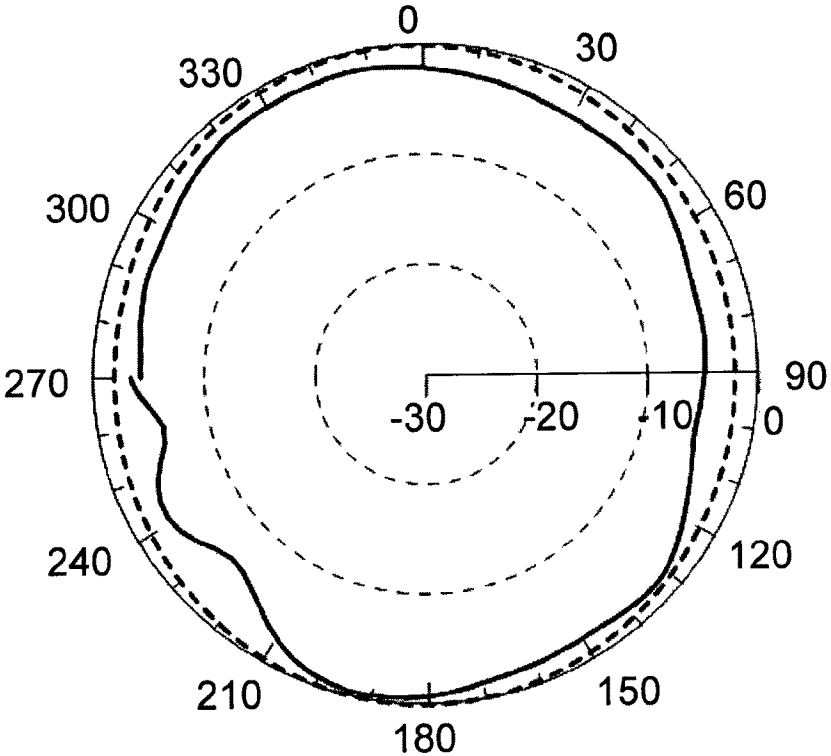
Figure 3F:
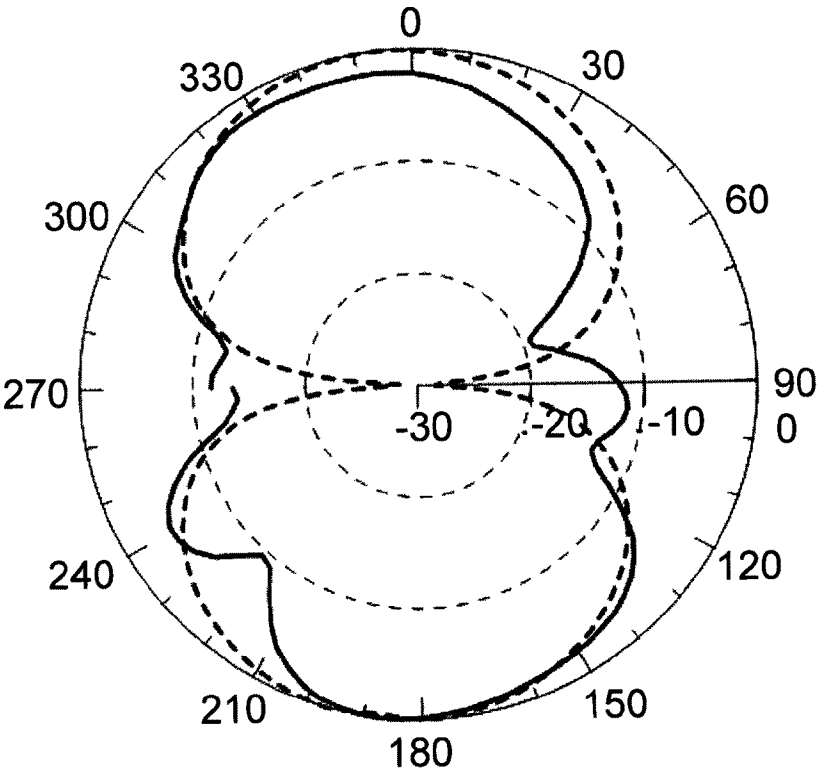
Figure 3E:
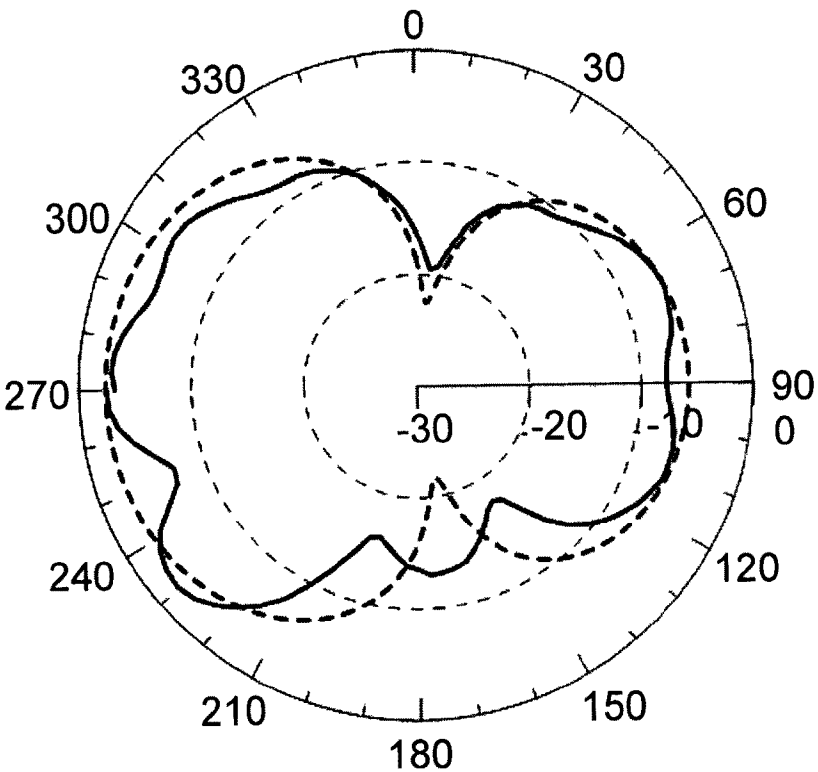
Figure 4B:
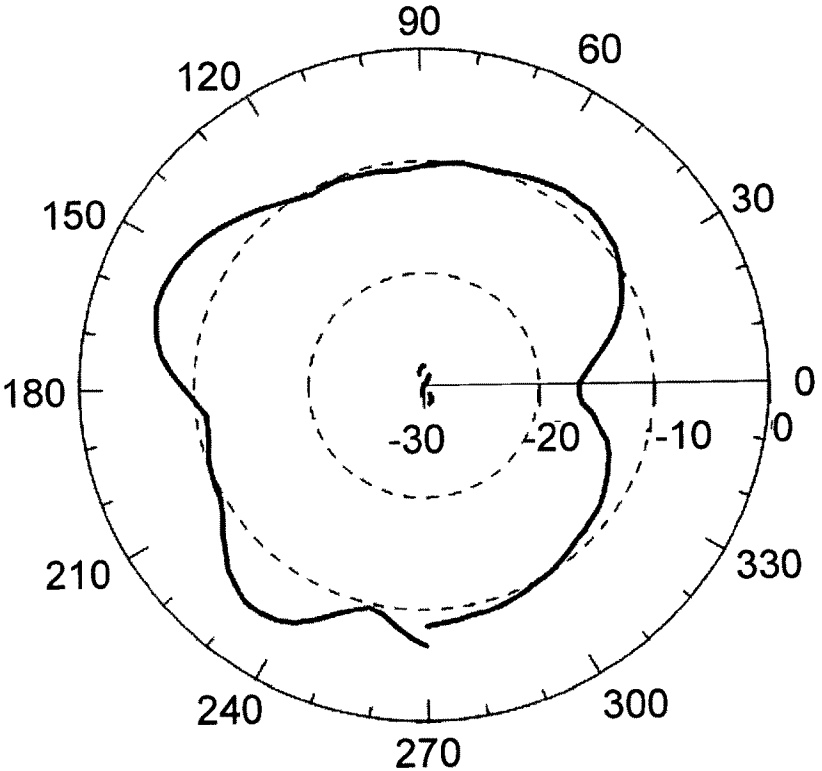
FIGS. 4A-4F show the measured and the simulated field patterns of the antenna device of the first embodiment of the invention in the working mode YY.
Figure 4A:
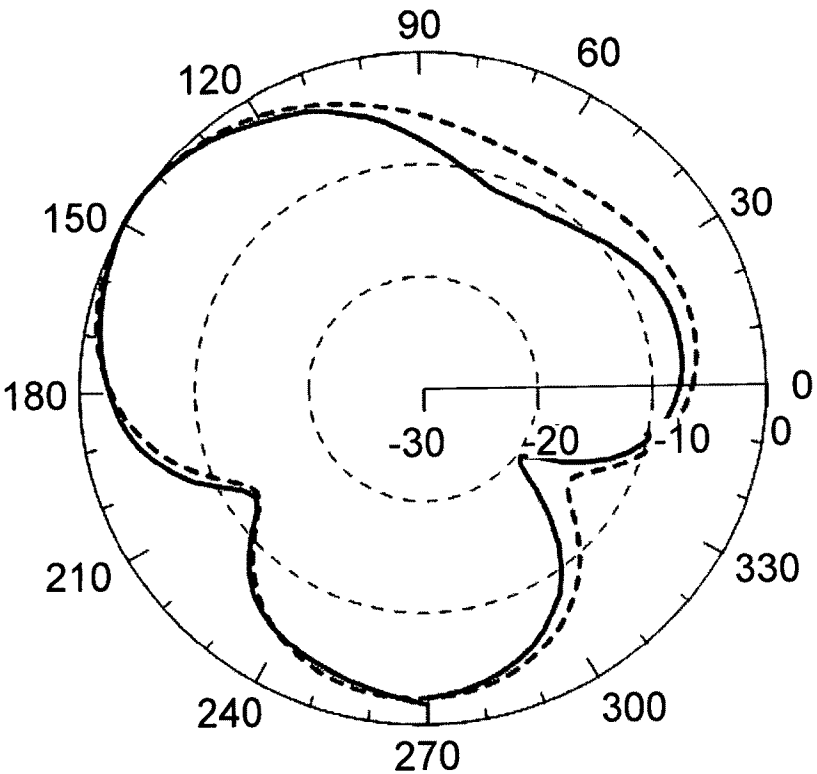
Figure 4D:
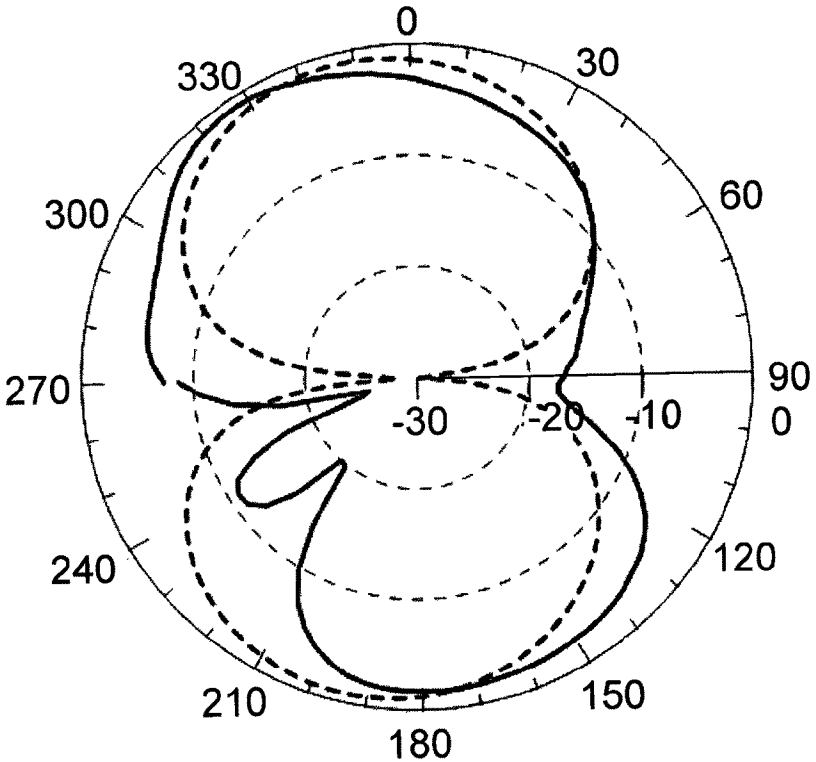
Figure 4C:
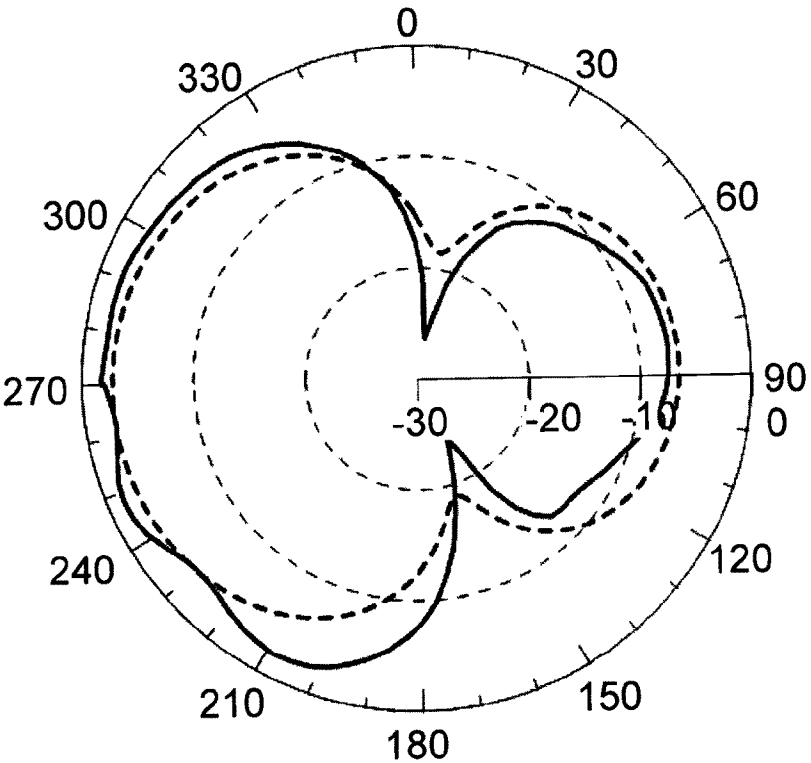
Figure 4F:
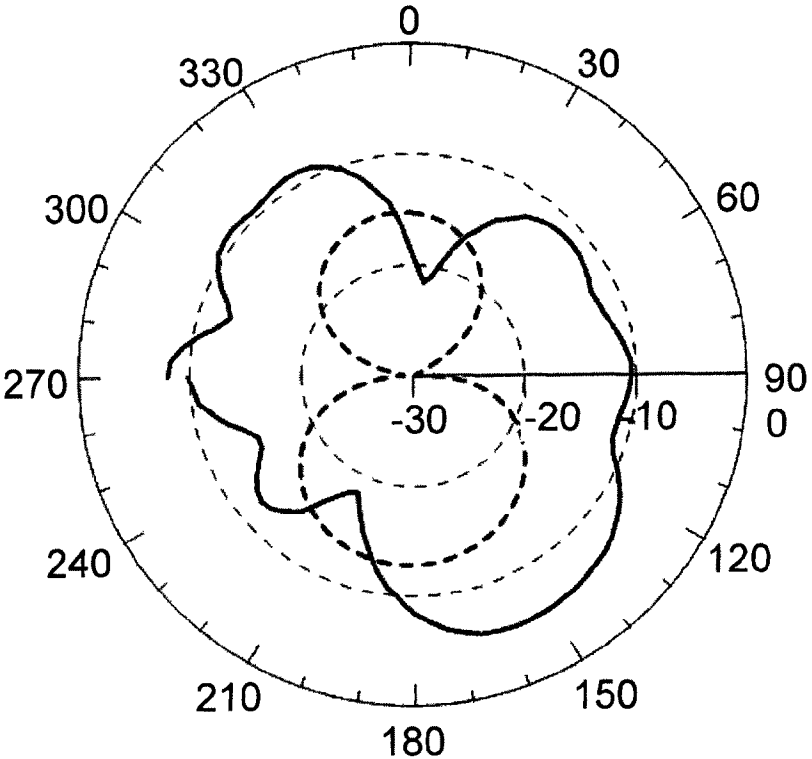
Figure 4E:
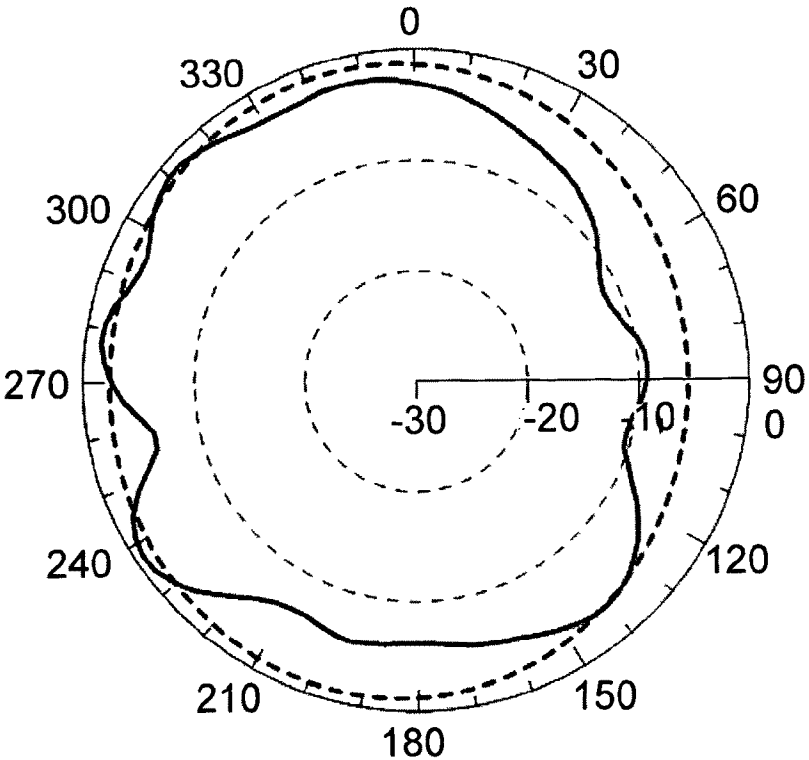

Referring to FIGS. 3A-3F, the measured and the simulated field patterns of the antenna device of the first embodiment of the invention in the working mode XY are shown. FIGS. 3A, 3C and 3E are the field patterns of $E_\psi$, and FIGS. 3B, 3D and 3F are the field patterns of $E_\theta$. The solid line denotes the measured field pattern, and the dotted line denotes the simulated field pattern. Also, referring to FIGS. 4A-4F at the same time, the measured and the simulated field patterns of the antenna device of the first embodiment of the invention in the working mode YY are shown. FIGS. 4A, 4C and 4E are the field patterns of $E_\psi$, on the XY-plane, the XZ-plane and the YZ-plane, respectively. FIGS. 4B, 4D and 4F are the field patterns of $E_\theta$ on the XY-plane, the XZ-plane and the YZ-plane, respectively. The solid line denotes the measured field pattern, and the dotted line denotes the simulated field pattern. As indicated in the field patterns, the antenna device 10 can have different radiation patterns in the different working modes. Thus, the antenna device 10 of the present embodiment provides many radiation patterns for the system to select from. When the antenna device 10 is operated, the system determines whether the antenna device 10 has to be switched to another mode according to the signal receiving state of the antenna device 10, such that a suitable radiation pattern is selected to increase the data receiving rate or the signal receiving quality.

Figure 5A:
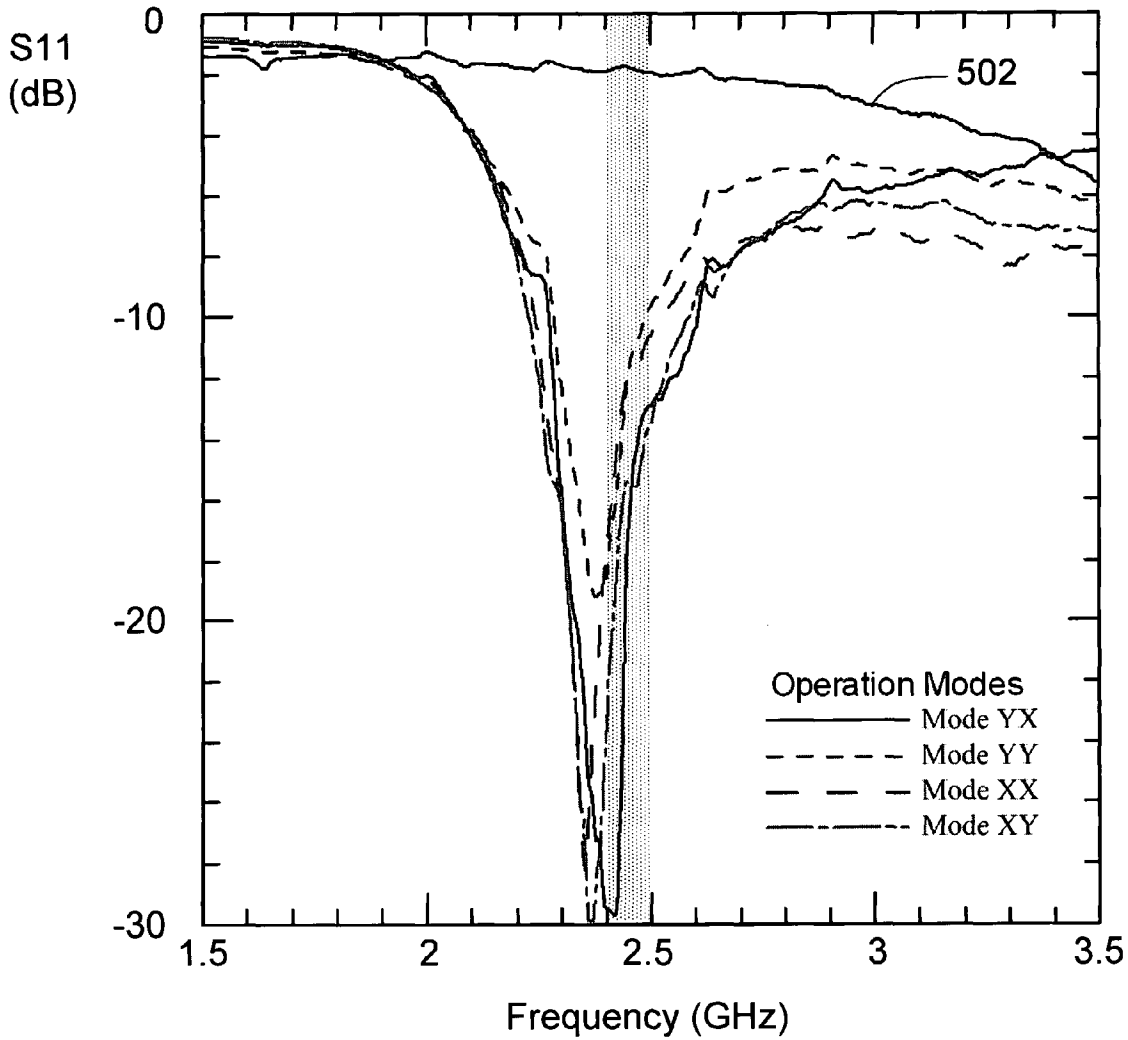
FIG. 5A shows a frequency response diagram of the reflective index S11 of the antenna device of the first embodiment of the invention in different working modes.
Figure 5B:
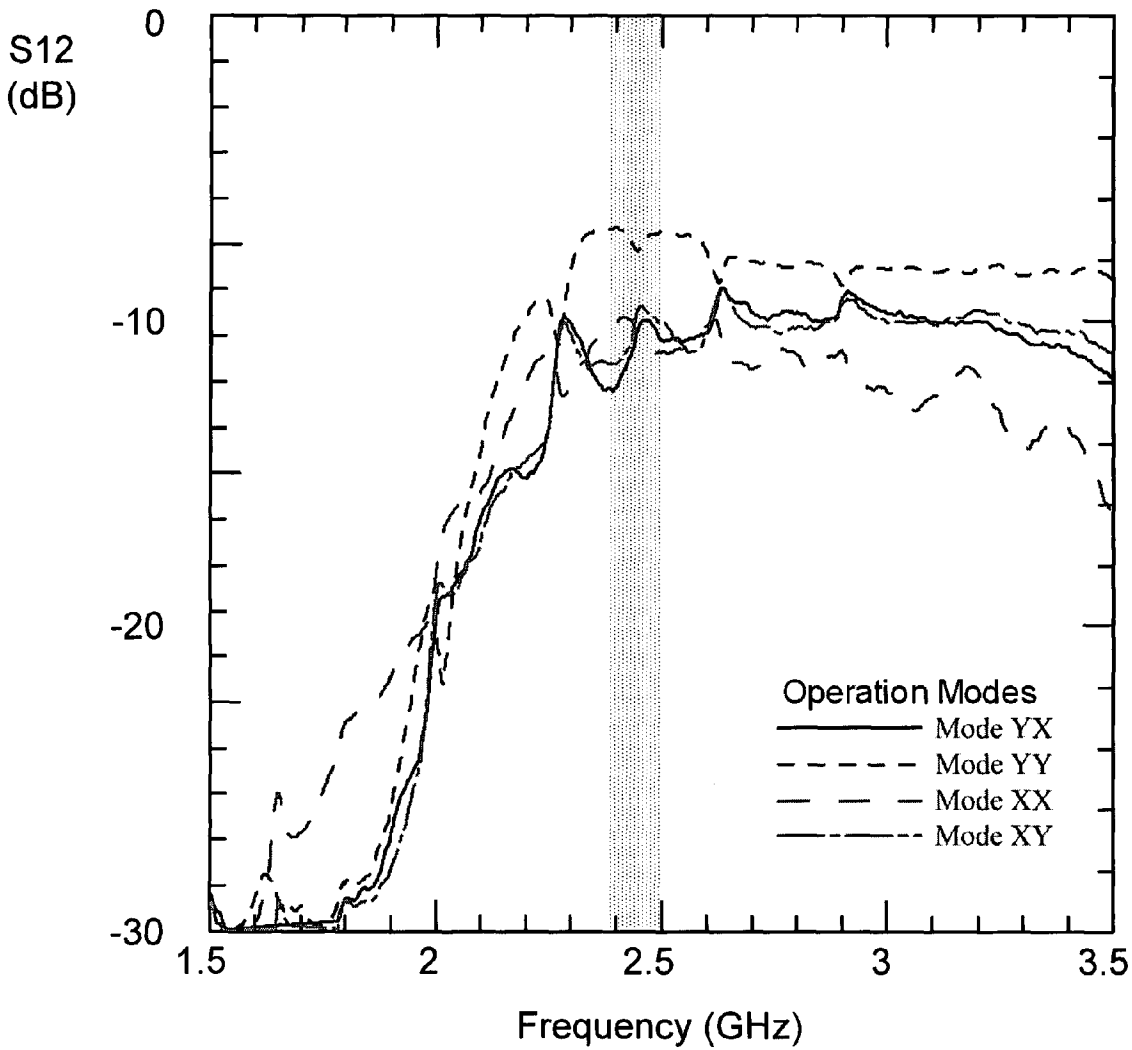
FIG. 5B shows a frequency response diagram of the isolation S12 of the antenna device of the first embodiment of the invention in different working modes.

Referring to FIGS. 5A and 5B, a frequency response diagram of the reflective index S11 of the antenna device of the first embodiment of the invention in different working modes and a frequency response diagram of the isolation S12 of the antenna device of the first embodiment of the invention in different working modes are shown, respectively. Let the working frequency band approximately range between 2.2 GHz-2.6 GHz. The curve 502 corresponds to the state that no diode is conducted. As indicated in FIG. 5B, in the working frequency band 2.2 GHz-2.6 GHz, the interference between the electromagnetic signals transmitted from the antennas formed by the two slots of the antenna device is within the range defined in the specification. Thus, FIGS. 5A and 5B show that the antenna device 10 of the present embodiment has an excellent signal receiving/transmissing effect.

Second Embodiment

Figure 6:
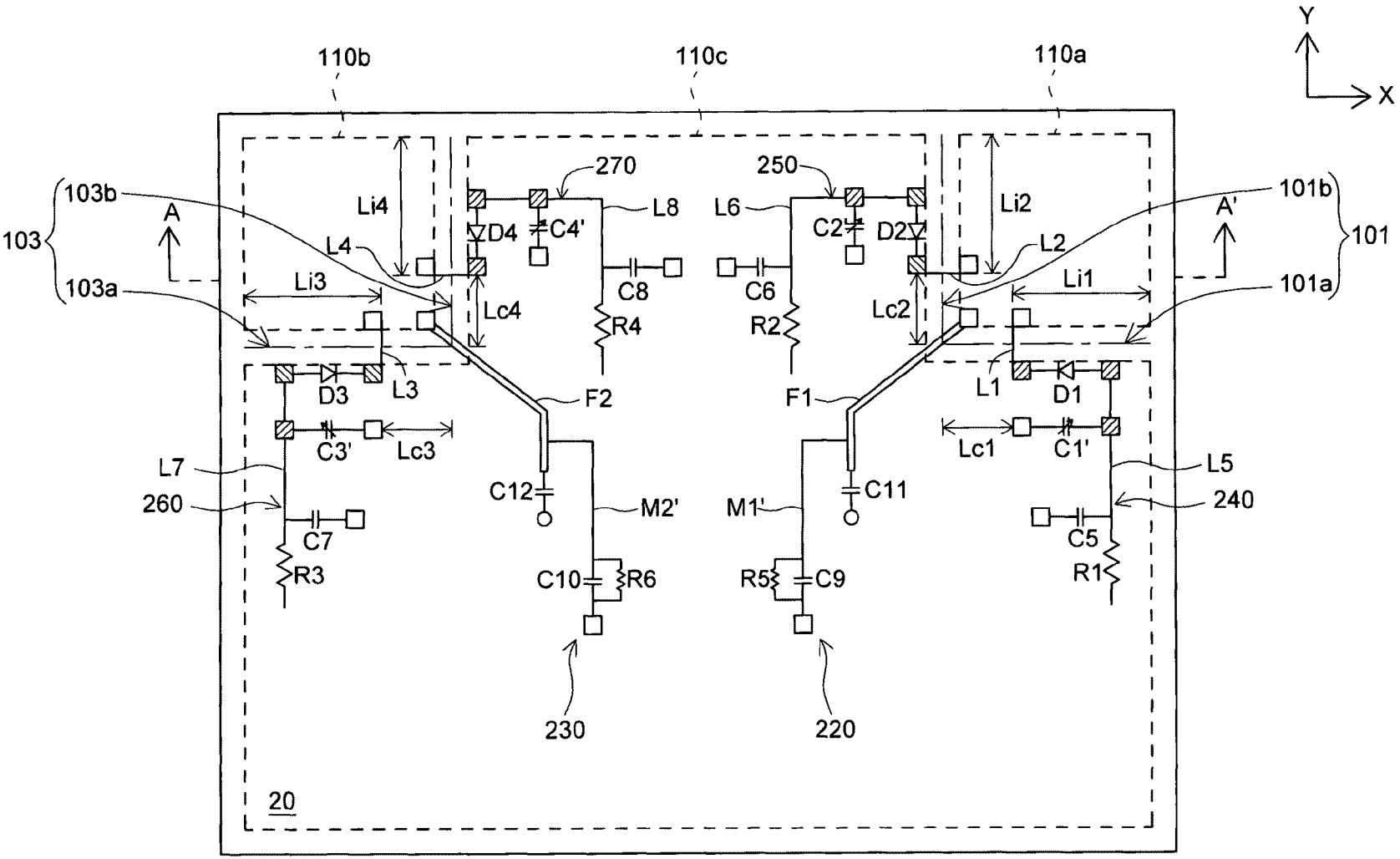
FIG. 6 shows a plane view of an antenna device according to a second embodiment of the invention.

Referring to FIG. 6, a plane view of an antenna device according to a second embodiment of the invention is shown. The differences between the antenna device 20 and the antenna device 10 of the first embodiment are the design of the control circuits and the feeding elements. As for the other elements similar to the first embodiment, the same designations are used and are not repeated here.

One feature of the present embodiment differing from the first embodiment is that a first capacitor C1' in a first control circuit 240, a second capacitor C2' in a second control circuit 250, a third capacitor C3' in a third control circuit and a fourth capacitor C4' in a fourth control circuit 270 all adopt variable capacitors. The variable capacitors can be, for example, implemented by varactor diodes. The capacitant value of the variable capacitor can be changed by changing the cross-voltage at the two terminals of the variable capacitor. As the capacitant value of the variable capacitor in each control circuit can be adjusted, the first slot and the second slot can transmit/receive electromagnetic signals with different frequencies when being operated in different working modes. Thus, the antenna device 20 is not only capable of adjusting the radiation pattern, but it is also capable of receiving/transmitting electromagnetic signals with different frequencies.

Another different feature between the present embodiment and the first embodiment is that a first microstrip line M1' is electrically connected to the third ground portion 110*c* via a ninth capacitor C9, and the ninth capacitor C9 is connected in parallel with a fifth resistor R5. Likewise, a second microstrip line M2' is electrically connected to the third ground portion 110*c* via a tenth capacitor C10, and the tenth capacitor C10 is connected in parallel with a sixth resistor R6.

Besides, the first conductive feeding line F1 is further electrically connected to the third ground portion 110*c* via an eleventh capacitor C11, and the second conductive feeding line F2 is electrically connected to the third ground portion 110*c* via a twelfth capacitor C12.

Figure 10:
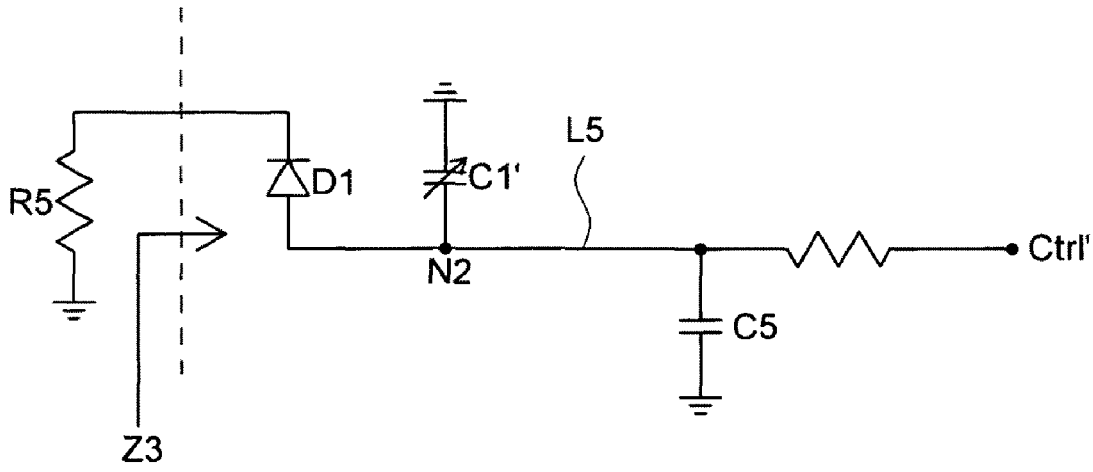
FIG. 10 shows an equivalent circuit diagram of the first control circuit of the second embodiment.

Referring to FIG. 10, an equivalent circuit diagram of the first control circuit 240 of the second embodiment is shown. The resonance occurs when the imaginary part of the sum of the impedance of the first capacitor C1' and the impedance of the equivalent inductance of the first diode D1 forward conducted is zero. The resonant frequency of the antenna can be changes by changing the capacitant value of the first capacitor C1', so that the frequency of the electromagnetic wave received/transmitted by the antenna formed by the first slot 101 can be changed. Therefore, the frequency of the electromagnetic wave received/transmitted by the antenna formed by the first slot 101 is adjustable.

Besides, when the first capacitor C1' is achieved by changing the cross-voltage at the two terminals of the first capacitor C1', the disposition of the fifth resistor R5 makes the voltage of the node N2 adjustable and not fixed at the forward cross-voltage of the first diode D1. The voltage at the node N2 is the sum of the forward cross-voltage of the first diode D1 and the cross-voltage of the fifth resistor R5. Thus, the capacitant value of the first capacitor C1' can be adjusted by changing the voltage of the control signal Ctrl'.

The ninth capacitor C9 makes one terminal of the first microstrip line M1' grounded when in high frequency. The twelfth capacitor C12 is used for isolating the direct current voltage. The ninth capacitor C9 and the twelfth capacitor C12 can effectively prevent the direct current voltage at the cathode of the first diode D1 from affecting the antenna formed by the first slot 101. The operation of the other control circuits are similar to the above disclosure and is not repeated here.

Figure 7:
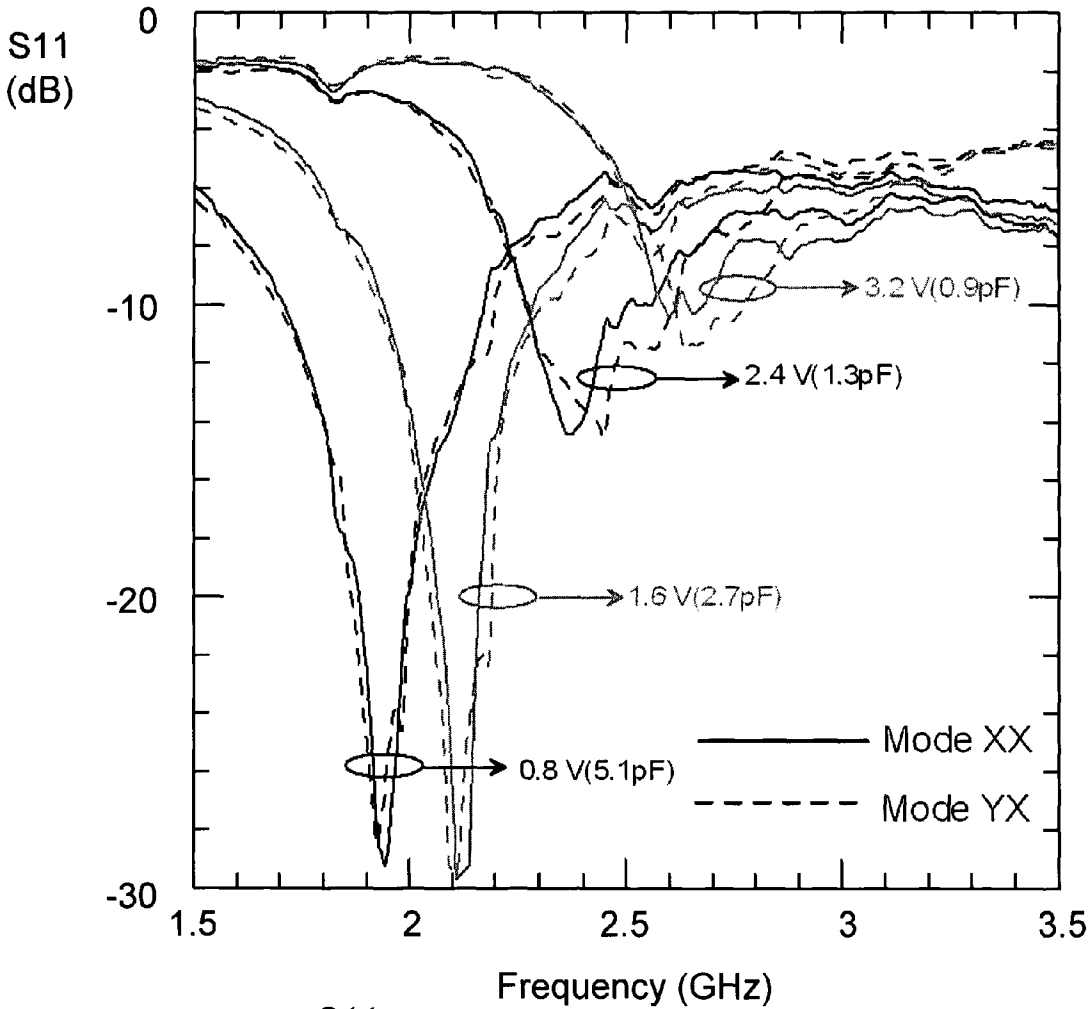
FIG. 7 shows a frequency response diagram of the reflective index S11 of the antenna device of the second embodiment of the invention in different working modes and having the variable capacitor with different capacitant values.

Referring to FIG. 7, a frequency response diagram of the reflective index S11 of the antenna device of the second embodiment of the invention in different working modes and having the variable capacitor with different capacitant values is shown. As indicated in FIG. 7, by changing the capacitant value of the variable capacitor, the antenna device 20 is capable of working in different frequencies bands, so that the antenna device 20 is capable of adjusting the frequency band.

According to the above embodiments of the invention, the antenna device has two sets of slot antennas having the specific structures, so that the antenna device having the MIMO technology can be miniaturized, light weighted and thinned. In addition, each set of the slot antenna is incorporated with two sets of the independent control circuits, so that the antenna device is capable of adjusting the radiation pattern so as to achieve the optimum signal transmission mode according to the communication environment, hence increasing the data transmission rate. If the variable capacitor is adopted in the control circuit, the antenna device will be capable of adjusting the field pattern and the frequency as well. Thus, the antenna device of the embodiment makes the MIMO technology applicable to small-sized portable electronic devices and achieves optimum communication quality by changing the field pattern according to the communication environment. The design of frequency reconfigurable antennas further makes electronic devices capable of adopting different communication protocols, so that communication device with a dual-mode or even a multi-mode can be provided.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An antenna device, comprising:

a substrate having a top surface and a lower surface;

a ground layer disposed on the lower surface, comprising:

a first ground portion;

a second ground portion; and a third ground portion separated from the first ground portion by a first slot and from the second ground portion by a second slot, wherein the first slot has a first segment and a second segment which together form a first angle, and the second slot has a third segment and a fourth segment which together form a second angle;

a first feeding element and a second feeding element both disposed on the top surface, and respectively comprising a first conductive feeding line and a second conductive feeding line, the first conductive feeding line crossing over the first slot and passing through the substrate to be electrically connected to the first ground portion, and the second conductive feeding line crossing over the second slot and passing through the substrate to be electrically connected to the second ground portion;

a first control circuit and a second control circuit both disposed on the top surface, and respectively comprising a first wire and a second wire, the first wire crossing over the corresponding position of the first segment of the first slot on the top surface and passing through the substrate to be electrically connected to the first ground portion, and the second wire crossing over the corresponding position of the second segment of the first slot on the top surface and passing through the substrate to be electrically connected to the first ground portion; and a third control circuit and a fourth control circuit both disposed on the top surface, and respectively comprising a third wire and a fourth wire, the third wire crossing over the corresponding position of the third segment of the second slot on the top surface and passing through the substrate to be electrically connected to the second ground portion, and the fourth wire crossing over the corresponding position of the fourth segment of the second slot on the top surface and passing through the substrate to be electrically connected to the second ground portion.

2. The antenna device according to claim 1, wherein the first conductive feeding line is electrically connected to the first ground portion at the intersection between the first segment and the second segment, and the second conductive feeding line is electrically connected to the second ground portion at the intersection between the third segment and the fourth segment.

3. The antenna device according to claim 1, wherein the first angle between the first segment and the second segment is substantially 90 degrees, and the second angle between the third segment and the fourth segment is substantially 90 degrees.

4. The antenna device according to claim 1, wherein the first control circuit comprises a first diode, the first wire is electrically connected to the cathode of the first diode, the second control circuit comprises a second diode, the second wire is electrically connected to the cathode of the second diode, the third control circuit comprises a third diode, the third wire is electrically connected to the cathode of the third diode, the fourth control circuit comprises a fourth diode, and the fourth wire is electrically connected to the cathode of the fourth diode;

wherein the diodes are conducted by controlling voltage at the anodes of the diodes, respectively.

5. The antenna device according to claim 4, wherein the first control circuit and the second control circuit further respectively comprise a first capacitor and a second capacitor, one terminal of the first capacitor and one terminal of the second capacitor are respectively coupled to the anode of the first diode and the anode of the second diode, and the other terminal of the first capacitor and the other terminal of the second capacitor are electrically connected to the third ground portion;

wherein the third control circuit and the fourth control circuit further respectively comprise a third capacitor and a fourth capacitor, one terminal of the third capacitor and one terminal of the fourth capacitor are respectively coupled to the anode of the third diode and the anode of the fourth diode, and the other terminal of the third capacitor and the other terminal of the fourth capacitor are electrically connected to the third ground portion.

6. The antenna device according to claim 5, wherein the first control circuit further comprises a fifth capacitor and a fifth wire, the second control circuit further comprises a sixth capacitor and a sixth wire, the fifth wire is connected to the first capacitor and the fifth capacitor, the sixth wire is connected the second capacitor and the sixth capacitor, the length of the fifth wire is approximately ¼ wavelength of a guided wave, and the length of the sixth wire is approximately ¼ wavelength of the guided wave;

wherein the third control circuit further comprises a seventh capacitor and a seventh wire, the fourth control circuit further comprises an eighth capacitor and an eighth wire, the seventh wire is connected the third capacitor and the seventh capacitor, the eighth wire is connected the fourth capacitor and the eighth capacitor, the length of the seventh wire is approximately ¼ wavelength of the guided wave, and the length of the eighth wire is approximately ¼ wavelength of the guided wave.

7. The antenna device according to claim 6, wherein the first control circuit further comprises a first resistor disposed between a signal input terminal of the first control circuit and the fifth capacitor, and the second control circuit further comprises a second resistor disposed between a signal input terminal of the second control circuit and the sixth capacitor;

wherein the third control circuit further comprises a third resistor disposed between a signal input terminal of the third control circuit and the seventh capacitor, and the fourth control circuit further comprises a fourth resistor disposed between a signal input terminal of the fourth control circuit and the eighth capacitor.

8. The antenna device according to claim 7, wherein the first feeding element further comprises a first microstrip line whose length is approximately ¼ wavelength of the guided wave, one terminal of the first microstrip line is electrically connected to the first conductive feeding line, and the other terminal of the first microstrip line is electrically connected to the third ground portion;

wherein the second feeding element further comprises a second microstrip line whose length is approximately ¼ wavelength of the guided wave, one terminal of the second microstrip line is electrically connected to the second conductive feeding line, and the other terminal of the second microstrip line is electrically connected to the third ground portion.

9. The antenna device according to claim 8, wherein the first microstrip line is electrically connected to the third ground portion via a ninth capacitor connected in parallel with a fifth resistor;

wherein the second microstrip line is electrically connected to the third ground portion via a tenth capacitor connected in parallel with a sixth resistor.

10. The antenna device according to claim 9, wherein the first conductive feeding line is electrically connected to the third ground portion via an eleventh capacitor, and the second conductive feeding line is electrically connected to the third ground portion via a twelfth capacitor.

11. The antenna device according to claim 5, wherein the first capacitor, the second capacitor, the third capacitor and the fourth capacitor are all variable capacitors.

* * * * *